United States Patent [19]

Balka, Jr.

[11] 4,372,283

[45] Feb. 8, 1983

[54] BALL SERVING APPARATUS HAVING INDEPENDENTLY OPERATING HORIZONTAL AND VERTICAL FIRING BARREL OSCILLATING MEANS

[76] Inventor: William J. Balka, Jr., 1120 Prospect St., Westfield, N.J. 07090

[21] Appl. No.: 263,409

[22] Filed: May 14, 1981

[51] Int. Cl.[3] ..... F41F 1/04

[52] U.S. Cl. ..... 124/56; 124/83

[58] Field of Search ..... 124/1, 56, 78, 81, 83, 124/9; 273/26 D, 29 A

[56] References Cited

U.S. PATENT DOCUMENTS

| | | | |
|---|---|---|---|
| 1,687,178 | 10/1928 | Peterson | 239/225 X |
| 2,668,526 | 2/1954 | Woolsey | 124/9 |
| 3,722,495 | 3/1973 | Hansen | 124/9 |
| 3,777,732 | 12/1973 | Holloway et al. | 124/78 |
| 3,807,379 | 4/1974 | Vodinh | 273/26 D X |
| 3,867,921 | 2/1975 | Politzer | 124/26 |
| 3,879,866 | 4/1975 | Gunderson | 193/22 X |
| 3,905,349 | 9/1975 | Nielsen et al. | 124/56 X |
| 3,911,888 | 10/1975 | Horvath | 124/56 |
| 3,913,552 | 10/1975 | Yarur et al. | 124/78 |
| 3,989,245 | 11/1976 | Augustine et al. | 273/29 A |
| 4,002,336 | 1/1977 | Beaver et al. | 124/56 X |
| 4,006,726 | 2/1977 | Sweeton et al. | 124/81 |
| 4,027,646 | 6/1977 | Sweeton | 124/56 |
| 4,203,413 | 5/1980 | Hodges | 124/78 |
| 4,233,953 | 11/1980 | Bash | 124/56 |
| 4,241,717 | 12/1980 | Mariani | 124/83 |
| 4,269,163 | 5/1981 | Feith | 273/29 A X |
| 4,280,697 | 7/1981 | Yuasa | 124/78 X |

*Primary Examiner*—Richard T. Stouffer

*Attorney, Agent, or Firm*—H. Hume Mathews

[57] ABSTRACT

An automatic ball serving apparatus for serving tennis balls for practice purposes. Balls which are loaded into a feed container are passed through a main bucket and fired through a firing barrel by compressed air. A pair of motors oscillate the firing barrel independently in both horizontal and vertical directions so that balls will be fired having random trajectory, distance and lateral displacement.

2 Claims, 5 Drawing Figures

BALL SERVING APPARATUS HAVING INDEPENDENTLY OPERATING HORIZONTAL AND VERTICAL FIRING BARREL OSCILLATING MEANS

BACKGROUND OF THE INVENTION

The present invention relates to the field of automatic tennis ball serving machines. Such machines are used for practice purposes, to serve a ball to a single player for improving the player's game. When activated, balls will be served automatically from the machine one after another in different directions both with respect to the trajectory of the served ball and its lateral displacement.

Many ball serving machines are known in the prior art, for example the machine disclosed in my prior U.S. Pat. No. 4,207,857 issued June 17, 1980 and the patents cited therein. These machines attempt to serve balls to a player for practice purposes. However, none of these prior art machines are completely satisfactory in all respects. Many of the machines are too large, having no mobility and result in serving the ball repeatedly to the same area. Other smaller, lighter machines which vary the direction of the ball to a certain extent, are of only very limited performance. None of these machines serve a ball in a random direction both in respect to the height of the served ball and its lateral displacement.

It has become necessary to invent an improved apparatus which will obviate these deficiencies of the prior art. In particular, a lighter, more portable and compact less expensive apparatus, which will randomly vary the direction of the served ball is needed. This invention meets those needs.

SUMMARY OF THE INVENTION

According to the present invention, an automatic ball serving machine is formed of a cylindrical can or bucket, a ball feed container mounted about the bucket, and a universally rotatable ball firing barrel. A conventional vacuum cleaner motor and air compressor, readily available commercially at a low cost, is used to supply compressed air into the main bucket. A pair of motors connected to the ball firing barrel by connecting rods, randomly control the lateral and azimuthal direction of the firing barrel, to form a novel combination, which results in a universally random ball serving apparatus. The new design of this invention is simple to assemble, and comprised of low cost components.

The apparatus takes balls to be served from the upper feed container and delivers them to the firing barrel which extends outside the main bucket, by means of a ball feed tube extending from a ball feed port in the bottom of the feed container through the main bucket to a point adjacent the inlet end of the firing barrel. As with prior ball servers and in particular, the "Automatic Ball Server" described in my previous U.S. Pat. No. 4,207,857 issued June 17, 1980 incorporated herein by reference, compressed air feeds the balls to the inlet end of the firing barrel and fires them when the proper pressure is built up.

While the ball firing mechanism is operating, to continuously fire tennis balls from the firing barrel, a pair of permanent magnet motors each rotating an offset cam oscillate the firing barrel, which is connected to the cams by connecting rods. One motor of the pair oscillates the barrel in one direction say horizontally, while the second motor of the pair, acting independently of the first oscillates the barrel in a direction perpendicular to the first direction.

The rotational speed of the two motors is deliberately geared differently so that balls will be fired in random directions both with respect to the trajectory and lateral displacement, and not always fired from the same firing position.

DESCRIPTION OF THE PREFERRED EMBODIMENT

Figure 1:
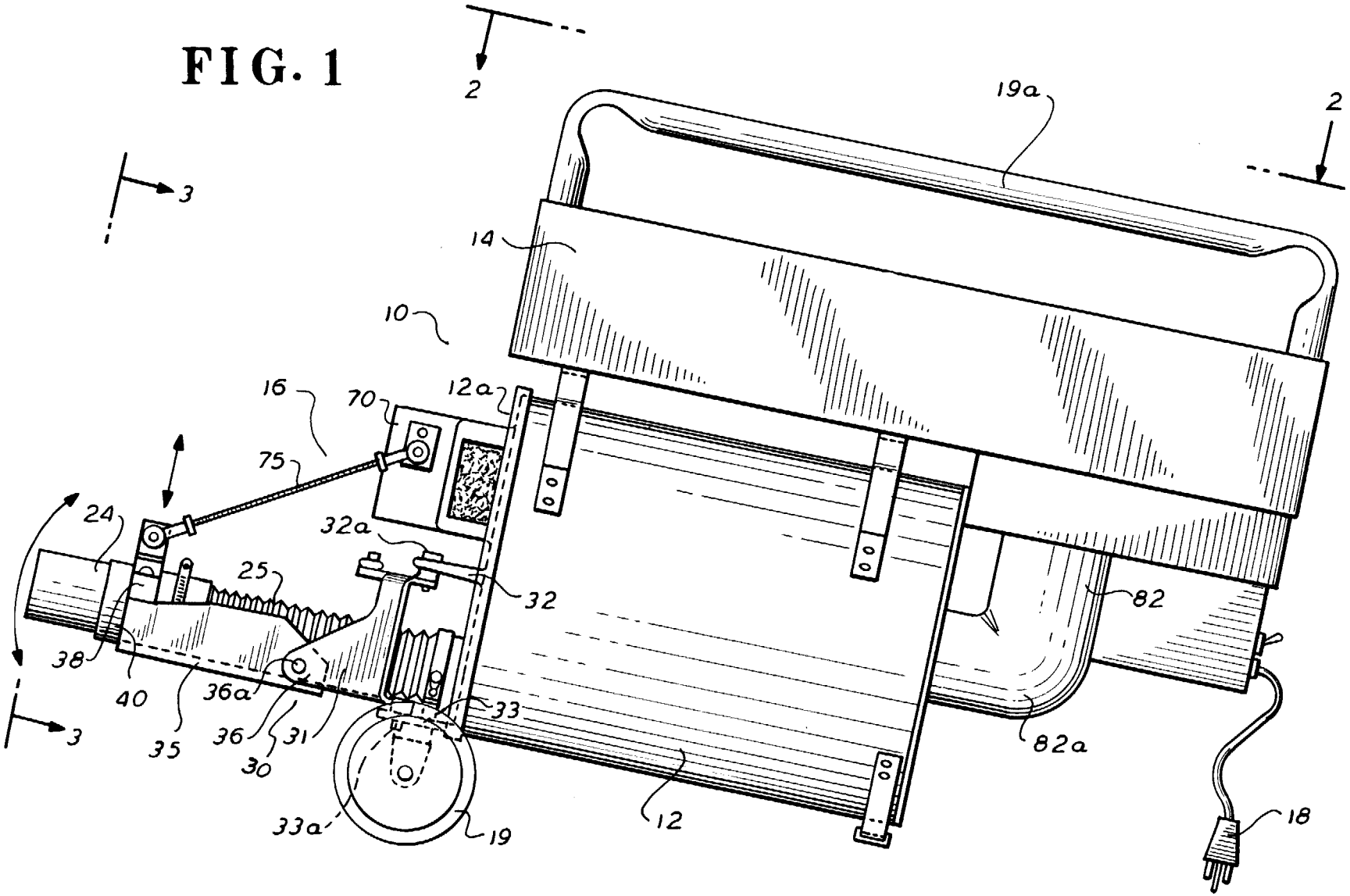
FIG. 1 is a side elevation of a preferredform of an automatic ball serving machine of the present invention.

Referring to FIG. 1, the presently preferred embodiment of the randomly directed ball serving machine 10 of the present invention comprises three main components, a compressed air bucket 12, which is preferably in cylindrical form, a ball feed container 14 and a rotatable barrel member 16.

Power to operate the apparatus including an air compressor motor, ball feed motor, and rotational motors, is supplied through an electric lead 18.

For ease of transportation, the entire machine may be mounted on wheels 19 at the lower end of machine 10 and pulled along by handle **19*a* attached to the upper end of feed container 14**.

The operation of the ball feed motor and the air compressor in addition to the manner in which the balls are fed to the firing barrel and the firing (or serving) of said balls are substantially similar to that which is described in my previously mentioned U.S. Pat. No. 4,207,857.

In the present invention, the compressed air bucket 12 is horizontally disposed, and accordingly, so are its internal components. In addition, a rectangular ball feed container 14 is employed above the compressed air bucket 12, whereas in my previous U.S. Pat. No. 4,207,857, a cylindrical ball feed container was mounted above a vertically disposed cylindrical air bucket.

In this particular embodiment, feed container 14 is in the shape of a rectangular openended box (see FIG. 2) having mounted therein a ball feed mechanism having a cylindrical portion 52, a rotor 56 which is rotated by a driveshaft and electrical motor (not shown). As described in my previous patent, rotor 56 has four holes 57, into which the balls drop, so as to be positioned one at a time in tube 82, where it falls or rolls on down and around the elbowed section **82*a*. At this point the ball is "picked up" or moved by the flow of air, which is passed into the feed tube and transported to the outlet end at the base 12*a* of bucket 12. The ball is then fired through flexible tube 25 and firing barrel 24. At the juncture of flexible tube 25 and firing barrel 24 is socket member 40, for the insertion of the firing barrel 24 into flexible tube 25** in a bayonet-type connection.

Figure 2:
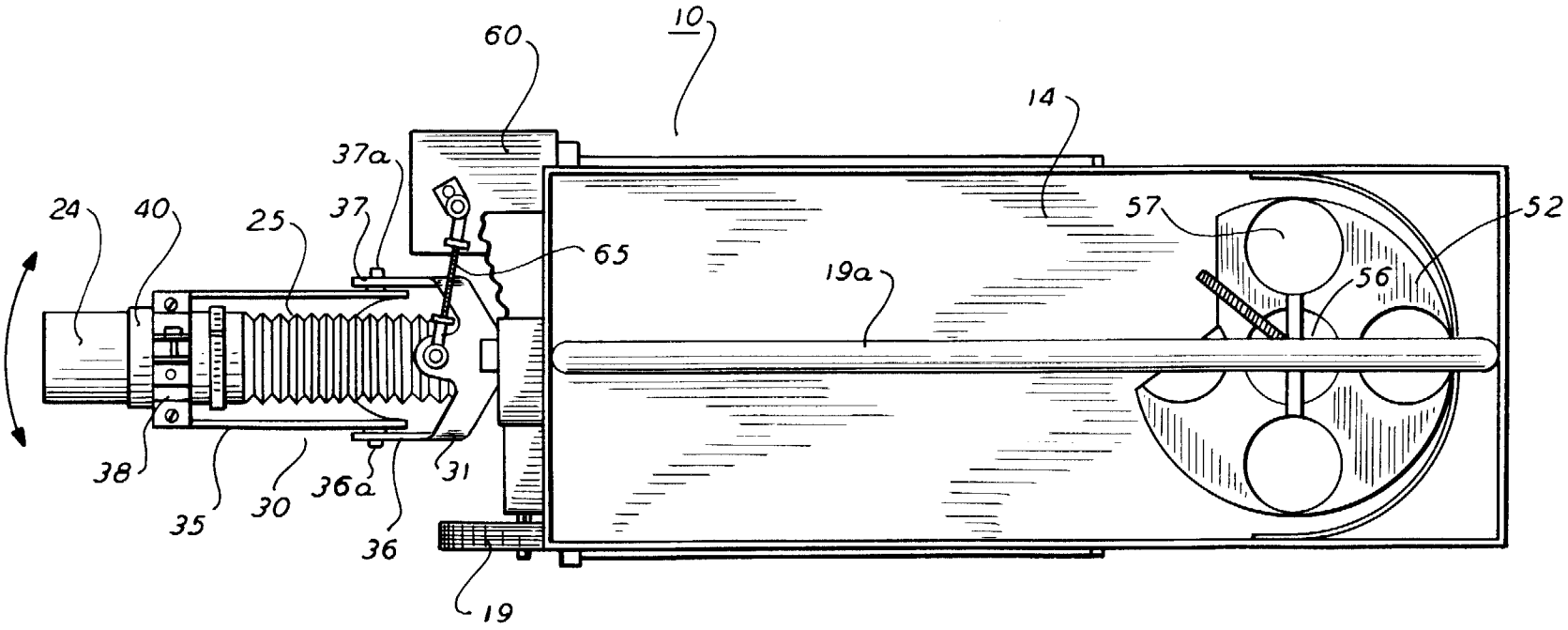
FIG. 2 is a top elevation of the machine of FIG. 1.

Firing barrel 24 is rotatably secured by a two piece brace 30, as shown in FIGS. 1 and 2. The inner section 31 of brace 30 is mounted rotatably to a pair of upper and lower support brackets 32 and 33, which extend from base 12*a*, and secured by a pair of pivot pins 32*a* and 33*a*. Thus, inner section 31 of brace 30 can be freely rotated in a horizontal plane on the pivot points created by pins 32*a* and 33*a*.

The outer section 35 of brace 30, having a U-shaped vertical cross-section is mounted rotatably to a pair of side-by-side mounts 36 and 37, extending outwardly from inner section 31 of brace 30 and secured by a pair of pivot pins 36*a* and 37*a*. The opposite end of outer section 35 is rigidly secured at 38 to socket member 40. Thus, outer section 35 of brace 30 can be freely rotated in the vertical plane on the pivot points created by pins 36*a* and 37*a*.

By simultaneously rotating brace 30 both horizontally and vertically, firing barrel 24 is universally oscillated so as to randomly vary its firing position.

Figure 3:
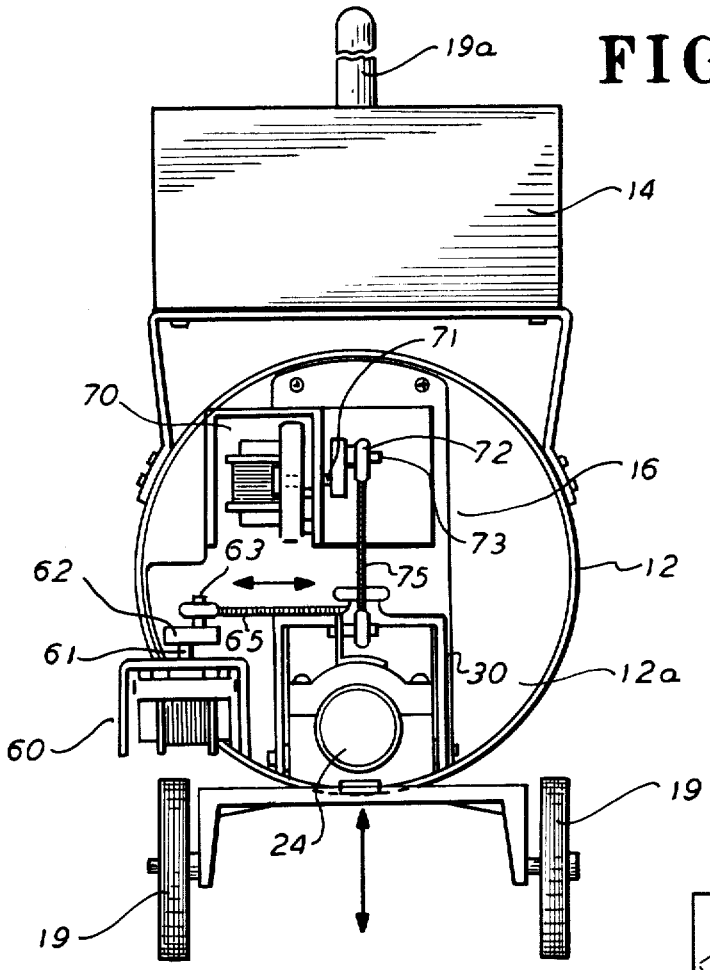
FIG. 3 is a front view of the machine of FIGS. 1 and 2.

The oscillation of support brace 30 is accomplished by a pair of permanent magnet motors 60 and 70 as shown in FIG. 3.

Horizontal oscillation motor 60, is mounted at the edge of the base 12*a* of bucket 12 to one side of brace 30. Motor 60 rotates a vertically extending central shaft 61 which is connected to an off-set cam 62 which is in turn connected to a camshaft 63. The rotation of cam 62, serves to operate a connecting rod 65 attached at one end to camshaft 63 and at its other end to the upper surface of inner portion 31 of brace 30.

Figure 5:
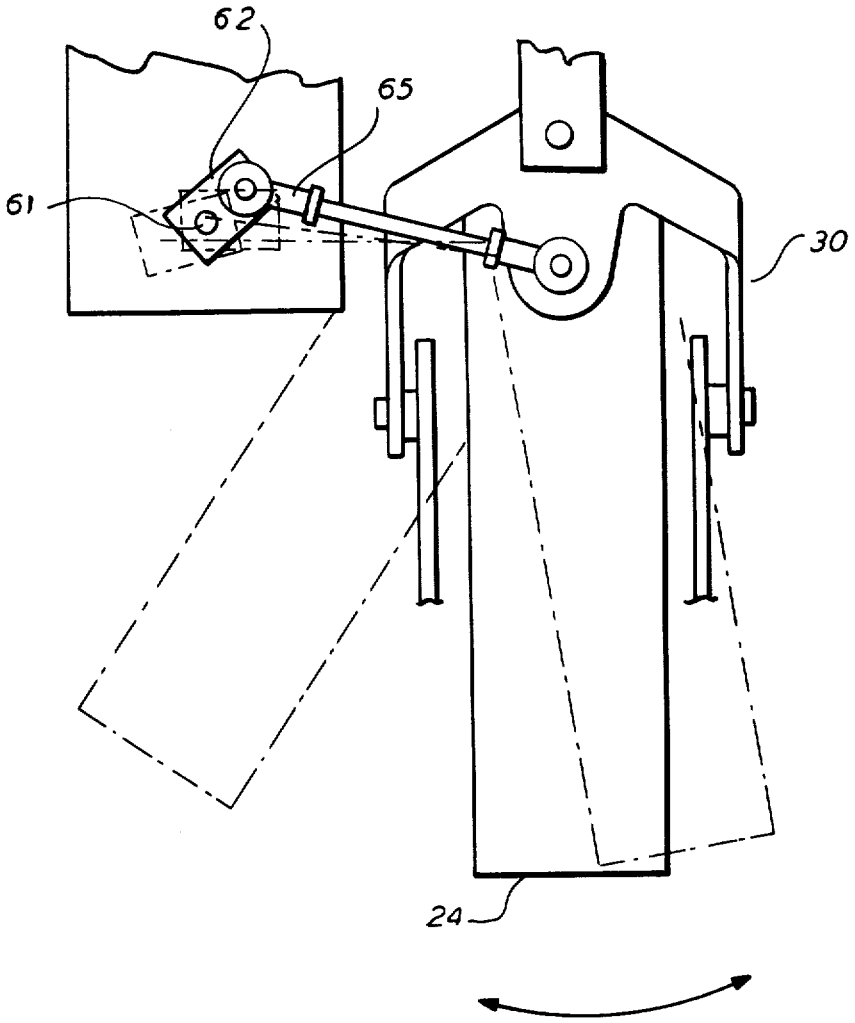
FIG. 5 is a top view of the horizontal rotational motor, connecting rod and firing barrel of FIGS. 1, 2 and 3 a range of barrel positions shown in phantom.

Referring now to FIG. 5, as cam 62 rotates about central shaft 61, the oscillation of connecting rod 65 will cause brace 30 to oscillate in a horizontal plane. Brace 30 will move firing barrel 24 through a range of horizontal positions (shown in phantom) in response to the related rotation of camshaft 63 (also shown in phantom).

In the present embodiment, the motor and connecting rod structure is designed to oscillate firing barrel 24 through a complete sweep of 22 degrees (11 degrees on each side of the center position).

Vertical rotation motor 70, is mounted at the edge of base 12*a* of bucket 12 about brace 30. Motor 70 rotates a horizontally extending central shaft 71 which is connected to an off-set cam 72 and camshaft 73. In a manner similar to that which previously described with reference to motor 60, the rotation of cam 72 serves to operate a connecting rod 75 attached at one end to camshaft 73 and mounted at its other end to socket member 40 with an L-bracket 40*a*.

Figure 4:
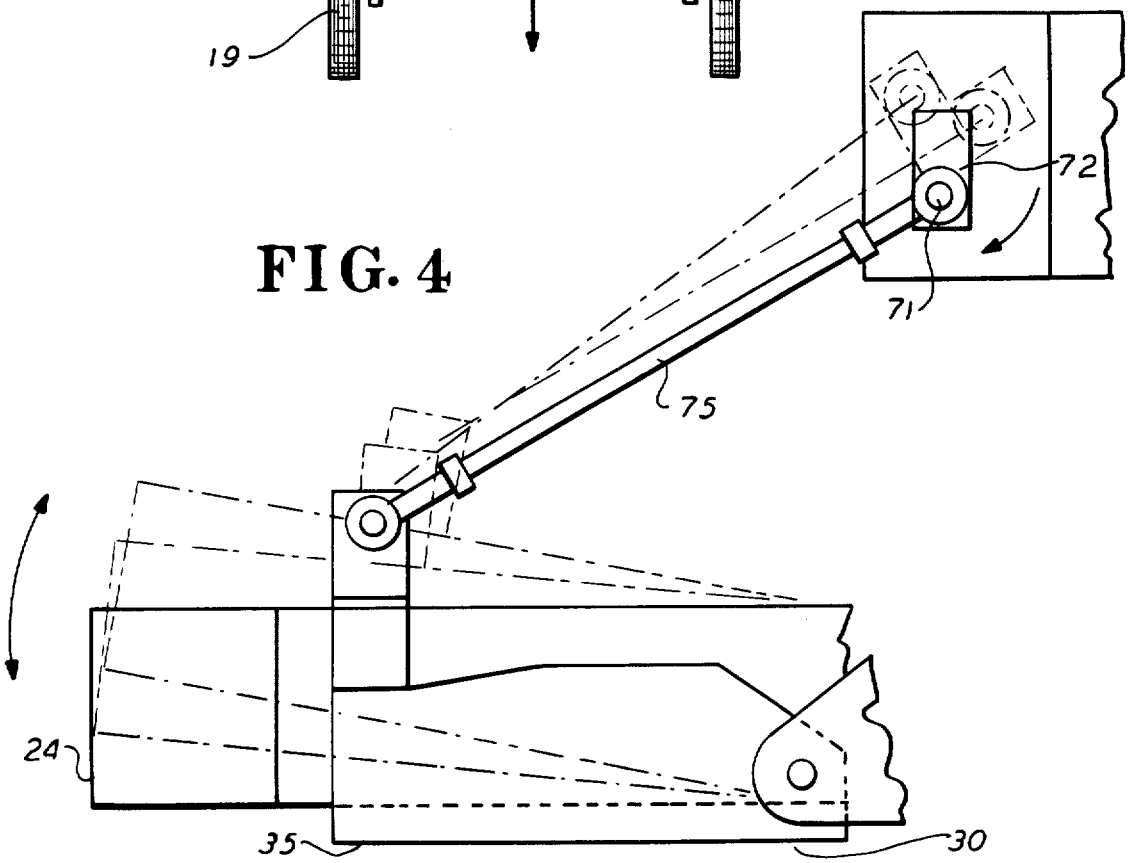
FIG. 4 is a side view of the vertical rotational motor, connecting rod and firing barrel of FIGS. 1 et seq, with a range of barrel positions shown in phantom.

As shown in FIG. 4, as cam 72 rotates about central shaft 71, the oscillation of connecting rod 75 will cause the outer section 35 of brace 30 to oscillate in the vertical plane about pivot points at 36*a* and 37*a*. Outer section 35 will move firing barrel 24 through a range of vertical positions (shown in phantom) in an up and down motion in accordance with the related rotation of camshaft 73 (shown in phantom).

In the present embodiment, the full vertical sweep of outer section 35 will be such that when the machine 10 is set at one base line of a tennis court it will drop fired balls in a range as close as just clearing the net, and as far as the opposite base line.

In order to insure that the barrel will be in a truely random position each time a ball is fired, the rotational speeds of each of the motors 60 and 70 are purposely made different.

In the present embodiment, motor 60, which oscillates firing barrel 24 through the horizontal plane, will turn at a rate of five revolutions per minute, so that it will complete one oscillation (one way and back) every 12 seconds. Motor 70, which oscillates firing barrel 24 through the vertical plane, will turn at a rate of 12 revolutions per minute, so that it will complete one oscillation (up and down) every five seconds.

This simultaneous operation of these motors at these specified rates of speed will insure that firing barrel will be in different firing positions each time a ball is fired.

It is in the further contemplation of this invention that connecting rods 65 and 75 can be made telescopic so as to have adjustable lengths. By varying the length of the rods, the vertical and horizontal sweep of the firing barrel can be altered to provide further variations in the direction of fire.

What is claimed is:

1. In an automatic ball serving apparatus having a ball firing barrel connected by a flexible tube to a compressed air bucket disposed substantially horizontally and including a front end face from which compressed air is fed through said flexible tube into said barrel to fire balls therethrough, the improvement which comprises: a first brace section pivotally mounted to the lower part of said front end face for swinging movement relative to said compressed air bucket about a first axis, a second brace section pivotally mounted on said first brace section and attached to said firing barrel for pivotally mounting said firing barrel on said first brace section for swinging movement relative to said first brace section about a second axis disposed at a generally right angle to said first axis, a first motor mounted on said front end face above said first brace section, a first connector extending from said first motor to said barrel for continuously oscillating said firing barrel about said second axis, and a second motor mounted on said front end face spaced to the side of said first brace section, a second connector extending from said second motor to said first brace section for continuously oscillating said first brace section and thus the firing barrel also, about said first axis, whereby balls may be fired successively through said firing barrel so as to be discharged in random directions both in respect to the height of the served ball and its lateral displacement.

2. An apparatus according to claim 1, in which the motors independently move the firing barrel at different angular speeds.

* * * * *